United States Patent [19]

Collins

[11] Patent Number: 4,798,037

[45] Date of Patent: Jan. 17, 1989

[54] STEEL SOLDIER

[75] Inventor: John Collins, Nr. St. Albans, England

[73] Assignee: Mabey Hire Co., Limited, Reading, England

[21] Appl. No.: 29,369

[22] Filed: Mar. 23, 1987

Related U.S. Application Data

[63] Continuation of Ser. No. 712,982, Mar. 18, 1985, abandoned.

[51] Int. Cl.[4] ..... E04G 17/14; E04C 3/09

[52] U.S. Cl. ..... 52/731; 52/732; 249/210

[58] Field of Search ..... 249/2-8, 249/207, 210; 52/729-732; D25/77

[56] References Cited

U.S. PATENT DOCUMENTS

| | | | |
|---|---|---|---|
| 991,603 | 5/1911 | Brooks | 52/729 |
| 2,108,373 | 2/1938 | Greulich | 52/727 |
| 2,157,233 | 5/1939 | Geib, Jr. | 52/732 |
| 2,205,725 | 6/1940 | Kavanagh | 52/727 |
| 3,362,056 | 1/1968 | Preller et al. | 52/729 |
| 3,381,439 | 5/1968 | Thulin, Jr. | 52/729 |
| 3,444,664 | 5/1969 | Fink, Jr. et al. | 52/732 |
| 3,517,474 | 6/1970 | Lanternier | 52/729 |
| 4,112,649 | 9/1978 | Fritsch et al. | 52/731 |
| 4,177,968 | 12/1979 | Chapman | 52/730 |

FOREIGN PATENT DOCUMENTS

| | | | |
|---|---|---|---|
| 580943 | 7/1933 | Fed. Rep. of Germany | 52/729 |
| 414118 | 12/1966 | Switzerland | 52/729 |
| 473613 | 10/1937 | United Kingdom | 52/729 |
| 1551154 | 8/1979 | United Kingdom . | |

OTHER PUBLICATIONS

"Load Performance Evaluation of Mk2 Formwork Soldiers for Mabey and Johnson Ltd." by Kinnear et al., Polytechnic of Central London, 8/1975.

"Mabey MkII Soldier: Test Report", Mabey & Johnson Ltd., Jul. 1976.

"Mabey MkIII Soldier: Test Report", Mabey & Johnson Ltd., Jan. 1977.

"Report on the Testing of Mabey & Johnson 230HD & Mk2 Soldiers", Harry Stanger Ltd., Dec. 1983.

"Report of Load Tests on 230 HD Soldiers: Test Series 2", Harry Stanger Ltd., May 1984.

"Mabey MkIII 230 HD Soldier: Test Report", Mabey & Johnson Ltd., Jan. 1984.

*Primary Examiner*—Jay H. Woo
*Assistant Examiner*—James C. Housel
*Attorney, Agent, or Firm*—Leydig, Voit & Mayer

[57] ABSTRACT

A steel soldier of increased strength and rigidity for supporting concrete formwork comprises a pair of steel beam elements connected in laterally spaced opposite parallel relation by a tie plate (3) at each end and is characterized in that each beam element has a web with lateral extensions (1) which enter within and are supportively attached (a,b) to separately formed hollow profile chord plates (2).

6 Claims, 1 Drawing Sheet

STEEL SOLDIER

This application is a continuation of application Ser. No. 712,982, filed Mar. 18, 1985, now abandoned.

This invention relates to an improved steel soldier for supporting concrete formwork and represents an improvement or modification of the steel soldier which is disclosed in British Patent Specification No. 1551154.

That steel soldier comprised a pair of steel beam elements connected in laterally spaced opposite parallel relation by a tie plate at each end, each beam element having the form of a folded steel plate with a flat web portion extending into a pair of substantially tubular profile chords which are of substantially symmetrical configuration relative to the plane of the web. The chords may be of circular, oval, rectangular or other symmetrical geometric configuration although a triangular configuration was preferred.

In accordance with the present invention a steel soldier comprises, as previously, a pair of steel beam elements connected in laterally spaced opposite parallel relation by a tie plate at each end but is characterised in that each beam element has a web with lateral extensions which enter within and are supportively attached to separately formed hollow profile chord plates.

A particular and at present preferred embodiment of the invention is illustrated in the accompanying drawing in which.

Figure 1:
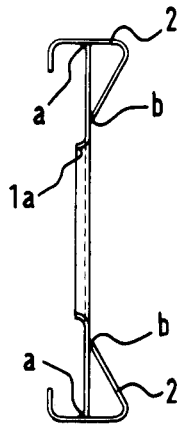
FIG. 1 is an end view of one beam element of a steel soldier.

Referring firstly to FIG. 1, the beam element there shown comprises a folded steel plate having a flat web 1 formed with a series of large lipped openings 1*a* along its length, one only of such openings being visible.

The web 1 is laterally extended so as to enter and give support to a pair of hollow profile chord plates 2 of somewhat channel shaped configuration which are attached to the web by welding at locations a and b respectively along the web edge and one web face.

Figure 2:
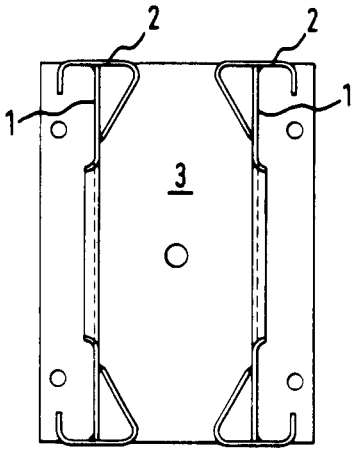
FIG. 2 is a cross-section of the complete steel soldier.

FIG. 2 shows how the complete soldier is comprised of two soldiers as above described mounted in parallel opposite facing spaced relation and connected at top and bottom by rectangular tie plates 3 of which one only is visible.

I claim:

1. A soldier comprising a pair of beam elements connected in substantially laterally spaced, opposite parallel relation by a tie plate at each end, wherein each beam element has an elongated web with opposite longitudinal edge extensions which enter within and are supportively attached to separately formed, asymmetrical, hollow profile chord plates, each chord plate, in conjunction with one face of each extension, defining a closed space of substantially triangular cross-section having a substantially right angle at the juncture of the edge of said extension and said chord plate and, on the opposite side of each extension, terminating in a flange which is spaced from and parallel to said extension.

2. A soldier as claimed in claim 1 in which each chord plate is welded to a side edge of a web and also to one face of the same web.

3. A soldier as claimed in claim 1 wherein the chord plates are positioned such that the defined spaces of substantially triangular cross-section extend toward one another.

4. A soldier comprising a pair of beam elements in substantially laterally spaced, opposite parallel relation and connected to a tie plate at each end, each beam element comprising.

an elongated web with a pair of opposite longitudinal edge extensions, each of which has opposing first and second faces; and a pair of separately-formed chord plates, the profile of each being substantially V-shaped, thereby defining two substantially flat portions each with a corresponding free end;

whereas each extension is supportively attached substantially perpendicularly to one of the substantially flat portions of a chord plate, with the free end of that portion terminating in a flange which is spaced from and parallel to the first face of the extension; and whereas the other substantially flat portion of each chord plate extends so that its free end contacts, and is supportively attached to, the second face of the respective extension so as to define a closed space of substantially triangular cross-section.

5. The soldier of claim 4 wherein the attachment of the chord plates to the extensions is a welded attachment.

6. The soldier of claim 4 wherein adjacent chord plates on the spaced beam elements are positioned such that the defined spaces of substantially triangular cross-section extend toward one another.

* * * * *